United States Patent [19]

Komamura et al.

[11] Patent Number: 4,871,647

[45] Date of Patent: Oct. 3, 1989

[54] METHOD OF FORMING COLOR DIFFUSION TRANSFER IMAGE BY HEAT DEVELOPMENT

[75] Inventors: Tawara Komamura; Satoru Ikeuchi; Masaru Iwagaki; Takashi Sasaki; Wataru Ishikawa, all of Tokyo, Japan

[73] Assignee: Konishiroku Photo Industry Co., Ltd., Tokyo, Japan

[21] Appl. No.: 185,374

[22] Filed: Apr. 22, 1988

Related U.S. Application Data

[63] Continuation of Ser. No. 852,374, Apr. 16, 1986, abandoned, which is a continuation of Ser. No. 529,028, Sep. 2, 1983, abandoned.

[30] Foreign Application Priority Data

Sep. 13, 1982 [JP] Japan ..... 57-160698
Dec. 30, 1982 [JP] Japan ..... 57-22964

[51] Int. Cl.[4] ..... G03C 5/54
[52] U.S. Cl. ..... 430/201; 430/203
[58] Field of Search ..... 430/203, 223, 201, 222

[56] References Cited

U.S. PATENT DOCUMENTS 4,142,891 3/1979 Baigrie et al. ..... 430/223
4,148,643 4/1979 Chapman et al. ..... 430/223
4,183,753 1/1980 Baigrie et al. ..... 430/223
4,241,163 12/1980 Myers et al. ..... 430/223
4,407,931 10/1983 Evans ..... 430/223
4,425,422 1/1984 Komamura et al. ..... 430/223
4,430,415 2/1984 Aono et al. ..... 430/203
4,439,513 3/1984 Sato et al. ..... 430/203
4,474,867 10/1984 Naito et al. ..... 430/203
4,478,927 10/1984 Naito et al. ..... 430/203
4,483,914 11/1984 Naito et al. ..... 430/203
4,500,626 2/1985 Naito et al. ..... 430/203

FOREIGN PATENT DOCUMENTS 2100458 12/1982 United Kingdom ..... 430/203

*Primary Examiner*—Richard L. Schilling
*Attorney, Agent, or Firm*—Jordan B. Bierman

[57] ABSTRACT

A method of forming a color diffusion transfer image by heat development is disclosed. This method comprises effecting imagewise exposure of a thermally developable photosensitive material containing an organosilver salt and a thermally non-diffusing color providing material capable of releasing a chelatable diffusing dye upon heat development, thermally developing the exposed photosensitive material to form an imagewise pattern of the chelatable dye from said color providing material, and diffusing and transferring at least part of said imagewise pattern into an image-receiving layer containing a polyvalent metallic ion that is superimposed on the photosensitive material, thereby forming on the image-receiving layer an imagewise pattern of the dye that has chelated with the polyvalent metallic ion.

9 Claims, No Drawings

METHOD OF FORMING COLOR DIFFUSION TRANSFER IMAGE BY HEAT DEVELOPMENT

This application which is a continuation of application Ser. No. 06/852,374, filed Apr. 16, 1986, now abandoned, which is a continuation of Ser. No. 06/529,028, filed Sept. 2, 1983 and now abandoned.

BACKGROUND OF THE INVENTION

1. Field of the Invention

The present invention relates to a method of forming a color diffusion transfer image by heat development. More particularly, the invention relates to a method capable of producing a sharp color image by diffusion transfer of an image formed in a thermally developed photographic material.

2. Description of the Prior Art

Conventionally, color images are formed with a photo-sensitive material (silver halide) by using a dye formed by the interaction of two components, i.e. the oxidation product of a color developing agent and a color coupler, or by the silver dye bleaching method wherein the image is formed by bleaching the dye with silver, or by the color diffusion transfer process used in instant color photography wherein the dye is diffused and transferred in an alkaline processing solution. Either of these methods requires a water-soluble processing solution and involves complicated image-forming procedures. Therefore, a novel heat development process that is dry and requires simple procedures to form a color image has long been desired.

Conventional methods of forming color images by heat development are described in Japanese Pat. No. 7782/69, U.S. Pat. Nos. 3,761,200 and 3,764,328, and Japanese Patent Applications (OPI) Nos. 27132/81 and 27133/81 (the symbol OPI as used herein means an unexamined published Japanese patent application). These methods depend on the interaction between the oxidation product of a color developing agent and a color coupler. However, in these methods, the silver image is formed in the area where the dye image is formed, so either color smearing by the silver image or staining of the background due to printout after development is unavoidable. To eliminate these problems, desilvering and fixing steps are necessary, but then, the simplicity and dryness of the heat development process are impaired.

Another type of method of forming a color image by heat development is the silver dye bleaching method described in Japanese Patent Applications (OPI) Nos. 105821/77, 105822/77, 50328/81, and U.S. Pat. No. 4,235,957. However, in order to bleach the dye image, an activated sheet containing a strong acid and a silver halide complexing agent is necessary, and this leads to complicated procedures and requires very careful handling of the strong acid.

Still another type of method of forming a color image by heat development is the diffusion transfer process that is described in Japanese Patent Applications (OPI) Nos. 179840/82 and 186744/82. This is an interesting approach that eliminates the defects of the first two methods, but on the other hand, the image formed by this method is low in archival quality and lightfastness, and its archival quality cannot be improved without sacrificing transferability.

SUMMARY OF THE INVENTION

One object of the present invention is to provide a method of forming a color diffusion transfer image by heat development that is capable of forming a dye image stable against ambient parameters such as heat, light and moisture.

Another object of the present invention is to provide a method of forming a color diffusion transfer image by heat development using a thermally non-diffusing color providing material capable of releasing a chelatable dye upon heat development.

These objects of the present invention can be accomplished by first effecting imagewise exposure of a thermally developable photosensitive material containing an organosilver salt and a thermally non-diffusing color providing material capable of releasing a chelatable diffusing dye upon heat development, thermally developing the exposed photosensitive material to form an imagewise pattern of the chelatable dye from said color providing material, and diffusing and transferring at least part of said imagewise pattern into an image-receiving layer containing a polyvalent metallic ion that is superimposed on the photosensitive material, thereby forming on the image-receiving layer an imagewise pattern of the dye that has chelated with the polyvalent metallic ion.

Other embodiments of this method are as follows: the diffusing dye is a chelatable and sublimable dye; the diffusing dye is transferred to the image-receiving layer by the sublimation of the diffusing dye, or is transferred together with an organic solvent, or is transferred after being molten; the non-diffusing color providing material is a material represented by the following formula (I):

Formula (I)

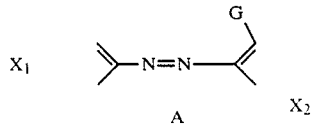

(wherein $X_1$ represents a group of atoms necessary to form aromatic or heterocyclic rings at least one of which has 5 to 7 atoms and in which at least one of the atoms adjacent to the carbon atoms bonded to the azo bond is (a) a nitrogen atom or (b) a carbon atom bonded to a nitrogen, oxygen or sulfur atom; $X_2$ represents a group of atoms necessary to form aromatic or heterocyclic rings at least one of which has 5 to 7 atoms; G represents a chelating group; and A represents a group capable of releasing a diffusing dye site as a function of heat development); and said non-diffusing color providing material is represented by the following formula (II):

Formula (II)

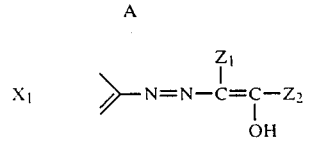

(wherein $X_1$ and A each has the same meaning as defined in formula (I); $Z_1$ represents an electron attractive group; and $Z_2$ represents an alkyl or aryl group.)

DETAILED DESCRIPTION OF THE PREFERRED EMBODIMENTS

The color providing material used in the present invention is thermally non-diffusing and is preferably poorly soluble in organic solvents used in its transfer to the image-receiving layer. A preferred compound for use as the thermally non-diffusing color providing material (hereunder simply referred to as the color providing material) is represented by formula (I):

Formula (I)

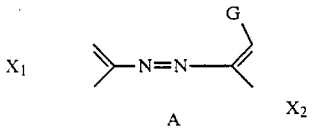

(wherein $X_1$ represents a group of atoms necessary to form aromatic or heterocyclic rings at least one of which has 5 to 7 atoms and in which at least one of the atoms adjacent to the carbon atoms bonded to the azo bond is (a) a nitrogen atom or (b) a carbon atom bonded to a nitrogen, oxygen or sulfur atom, said rings optionally having a suitable substituent such as an alkyl group, alkoxy group, cyano group, hydroxyl group, thiol group, thioalkoxy group, amino group, nitro group or halogen atom; $X_2$ represents a group of atoms necessary to form aromatic or heterocyclic rings at least one of which has 5 to 7 atoms, a ring of said rings that being preferably a benzene ring, naphthalane ring, pyridine ring, pyrazolone ring or quinoline ring, and optionally having a substituent such as an alkyl group, alkoxy group, cyano group, hydroxyl group, thiol group, thioalkoxy group, amino group, nitro group or halogen atom; G represents a chelating group, preferably a hydroxyl group, amino group, methoxy group, thiol group or thioalkoxy group; when the chelatable dye to be released is a sublimable dye, the rings formed of the atomic groups represented by $X_1$ and $X_2$ are preferably substituted by an alkyl group, alkoxy group, cyano group, hydroxyl group, amino group or halogen atom; and A represents a group capable of releasing a diffusing dye site as a function of heat development.)

Another preferred color providing material is a compound represented by formula (II):

Formula (II)

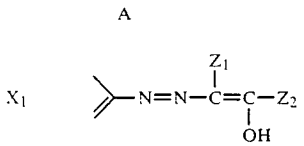

(wherein $X_1$ and A are each the same as defined in formula (I); $Z_1$ is an electron attractive group which is preferably an acetyl group, benzoyl group, cyano group or acetamide group; and $Z_2$ is an alkyl group, preferably methyl, or an aryl group, preferably phenyl.)

In the formulas (I) and (II), an example of the group represented by A which is capable of releasing a dye as a function of heat development is represented by formula (III):

Formula (III)

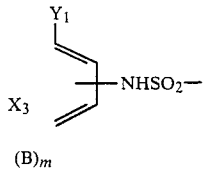

(wherein $X_3$ represents a group of atoms necessary to form a benzene ring, naphthalene ring or a heterocyclic ring such as a pyrazolone ring or pyrimidine ring; $Y_1$ represents a hydroxyl group or amino group; the $-NHSO_2$ group represents bonded to ortho or para position with respect to $Y_1$; B represents a group that substantially immobilizes the released dye and is preferably a hydrophilic group or a group substituted by a hydrophilic group; and m represents 0, 1 or 2.)

Another example of the group represented by A is represented by formula (IV):

Formula (IV)

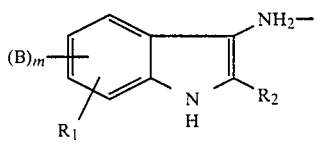

(wherein B and m are the same as defined in formula (III); $R_1$ represents a hydrogen atom, halogen atom, alkyl group or alkoxy group; and $R_2$ represents an alkyl group, phenyl group, carboamide group or hydrogen atom.)

A further example of the group represented by A is represented by formula (V):

C-J- Formula (V)

wherein C represents a substrate (coupler residue) to bind with the oxidation product of a color developing agent; and J represents a divalent binding group. Particularly preferred examples of C-J- are represented by the following formulas:

Formula (Va)

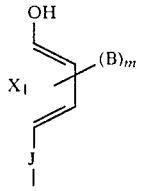

Formula (Vb)

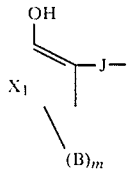

-continued

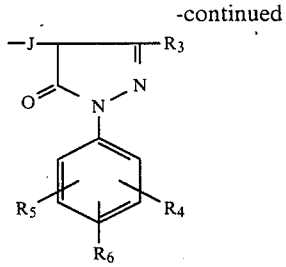

Formula (Vc)

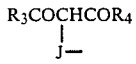

Formula (Vd)

wherein $X_1$, B and m are each the same as defined in formula (III); J represents a divalent binding group; and $R_3$, $R_4$, $R_5$ and $R_6$ represent each a hydrogen atom,alkyl group, aryl group, alkoxy group, aryloxy group, acyl group, acylamino group, N-substituted carbamoyl group, alkylamino group, arylamino group, halogen atom, acyloxy group, cyano group or the same group as what is represented by B in formula (III).

Still another example of the group represented by A is represented by formula (VI):

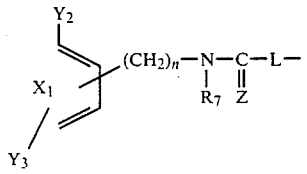

Formula (VI)

wherein $X_1$ is the same as defined in formula (III); $Y_2$ represents an oxidizable nucleophilic group; $Y_3$ represents a hydroxyl group or amino group substituted at ortho- or para-position with respect to $X_1$; Z represents an oxygen or sulfur atom; L represents

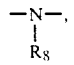

—O— or —S—; $R_7$ and $R_8$ represent each a hydrogen atom, alkyl group or aryl group; and n represents 0, 1 or 2.

A further example of the group represented by A is represented by formula (VII):

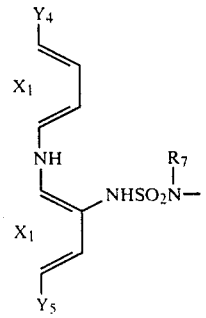

Formula (VII)

wherein $X_1$ and $R_7$ are each the same as defined in formula (VI); and $Y_4$ and $Y_5$ represent each a hydrogen atom, hydroxyl group or amino group.

When the releasable dye is of subliming nature, groups having formulas (V), (VI) and (VII) are particularly preferred.

Photographic materials of heat development type that form a black-and-white silver image are described in Japanese Patent Publications Nos. 4924/68, 19166/68, 4728/71, 26582/69, 12700/70, 18416/70 and Japanese Patent Application (OPI) No. 52626/74. The basic formulation of these materials consists of a support, photosensitive silver halide, a metal (silver) salt or complex of an organic compound, a developing agent and a binder. These known photographic materials of heat development may be used in the present invention. They may further contain any of the usual photographic additives such as color conditioning agents, chemical sensitizers, development conditioners, antifoggants, spectral sensitizers, filter dyes, antihalation dyes, alkali releasing agents and the like.

For further details of the components in the photographic material of the heat development type, such as support, photosensitive silver halide, metal (silver) salt or complex of organic compound, developing agent, binder, color conditioner, chemical sensitizer, development conditioner, antifoggant, spectral sensitizer, filter dye, antihalation dye and alkali releasing agent, see Research Disclosure, pp. 9–15, June 1978. Suitable arrangements may be selected for the purposes of the present invention on the basis of this reference.

Various binders may be used in the present invention, and hydrophilic or hydrophobic binders are preferred. Specific examples include proteins such as gelatin, gelatin derivatives, casein, sodium casein and albumin; cellulose derivatives such as ethyl cellulose; polysaccharides such as dextrin and agar; natural substances such as gum arabic and gum tragacanth; synthetic polymers such as polyvinyl alcohol, polyvinylpyrrolidone and water-soluble polyvinyl acetal; and vinyl compounds in latex form that increase the dimensional stability of photographic materials. Other advantageous synthetic polymers are described in U.S. Pat. Nos. 3,142,586, 3,193,386, 3,062,674, 3,220,844, 3,287,289 and 3,411,911. Effective polymers are those water-soluble polymers based on alkyl acrylates, alkyl methacrylates, acrylic acid, sulfoalkyl acrylates and methacrylates. And other advantageous polymeric materials include polyvinyl butryal, polyacryl amide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadiene-styrene copolymer, vinyl chloride-vinyl acetate copolymer, vinyl acetate-vinyl chloride-maleic acid copolymer, polyvinyl acetate, benzyl cellulose, cellulose acetate, cellulose propionate and cellulose acetate phthalate. These synthetic polymers may be used either alone or in combination. The binder is used in an amount of 0.1 to 10 parts, preferably 0.25 to 4 parts, by weight per part of the organosilver salt in each photosensitive layer.

In a specific embodiment, the photographic material of heat development type according to the present invention has at least one layer (A) formed on a support. Layer (A) contains in a binder (a) photosensitive silver halide, (b) a silver salt of organic compound, (c) a heat developing material such as a developing agent, and (d) the color providing material according to the present invention. Components (a) to (d) may be contained in the same layer or in different layers so long as they are in a state where they are reactive with each other. If the color providing material has an absorption wavelength that is included in the sensitive wavelength region of the silver halide which is combined with that material, it is preferably incorporated in a position that does not reduce the photosensitivity of the silver halide, namely, on the side opposite a light source for exposure with respect to the silver halide layer. However, if the absorption wavelength differs from that of the chelate dye formed in the image-receiving layer and is not included in the sensitive region of the silver halide, the color-providing material and the silver halide may be incorporated in the same layer.

The image-receiving layer according to the present invention has a polyvalent metallic ion on or within the layer, and its surface is substantially colorless or white in color. The image-receiving layer is formed of a support and a layer containing the polyvalent metallic ion. The ion-containing layer is formed by incorporating in a binder a polyvalent metal ion or a metal ion providing material containing that polyvalent metal ion. The metal ion providing material itself may be a binder. Preferred metal ion providing materials are described in Japanese Patent Publication No. 77535/61, and Japanese Patent Applications (OPI) Nos. 48210/80 and 129346/80. The support of the image-receiving layer may be made of any known material such as paper, plastic film, or plastic-paper composite. The image-receiving layer containing a polyvalent metal ion can also be prepared by incorporating the ion into the support or by immersing paper or any other suitable material in a solution of the polyvalent metal ion.

The most effective polyvalent metal ion for use in the present invention is such that it reacts quickly with the released dye to form a complex of the desired color, that it forms strong coordinate bonds with ligands, and that it remains substantially colorless in the image-receiving layer. Polyvalent metal ions having these properties are copper (II), nickel (II), palladium (II), zinc (II), platinum (II) and cobalt (II) ions. Copper (II) and nickel (II) ions are particularly preferred.

The image-receiving layer according to the present invention may be superimposed on the photographic material of the heat development type before exposure or after exposure and before development. Alternatively, the layer may be superimposed on the photographic material after development, followed by transfer of the dye image. After the transfer of the dye image, the image may be viewed through the support without removing the image-receiving layer, but preferably, said image-receiving layer is separated from the photographic material of the heat development type.

Any organic solvent that is capable of dissolving the released dye or transference to the image-receiving layer may be used in the present invention. Suitable examples include low-boiling solvents such as methanol, ethanol, methyl ethyl ketone, ethyl acetate, cyclohexanone, acetone and tetrahydrofuran; and high-boiling solvents such as N-n-butyl acetanilide, diethyl lauroylamide, dibutyl phthalate, tri-n-cresyl phosphate, N-dodecyl pyrrolidone and tri-n-nonyl phosphate. Heat-fusible compounds may also be used in the present invention. They are non-hydrolyzable compounds that are solid at ordinary temperatures and which, when heated to a desired processing temperature, melt to form solvents. Illustrative heat-fusible compounds are methyl anisate, acetamide, 1,6-hexanediol, decanediol, sorbitol, low-molecular weight polyethylene glycol, urea, thiourea and succinimide.

The above mentioned organic solvents may be used either alone or in combination. They may be incorporated in the photographic material before processing. Alternatively, they may be added to the upper layer of the photographic material or the image-receiving layer after exposure.

One example of the method of forming a color diffusion transfer image from the photographic material of the heat development type according to the present invention is hereunder described.

(1) A recording material made of the above-mentioned photographic material optionally superimposed on the image-receiving layer (or image-receiving sheet) is cut to a suitable size and subjected to imagewise exposure with a light source such as sunlight, tungsten lamp, fluorescent lamp, mercury lamp, halogen lamp (e.g. iodine lamp or xenon lamp), or laser light.

(2) The exposed recording material with the photosensitive layer of the photographic material being super-imposed on the image-receiving layer is heated at a temperature between about 50° and 250° C., preferably between 100° and 200° c., for a period between one second and 10 minutes, preferably between 5 and 180 seconds. Any known method of heating photographic materials of the heat development type may be used; for example, the recording material including the photosensitive layer and image-receiving layer is brought into contact with a hot plate or drum, or it is passed through heated air, or is heated by a high-frequency induction heater or a laser beam.

(3) Subsequently, the image-receiving layer is peeled from the photographic material. The layer carries a stable color image made of the dye chelated with the polyvalent metal ion. The chelated dye is stable against heat, light or moisture and will not diffuse by sublimation once it is transferred onto the image-receiving sheet.

Specific examples of the chelatable dye and color-providing material suitable for use in the present invention are listed below.

(Illustrative dyes)

Dye (1)

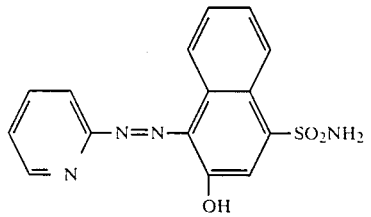

-continued
Dye (2)
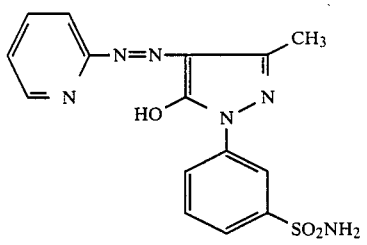
Dye (3)
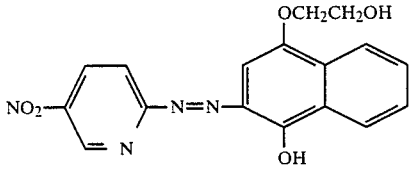
Dye (4)
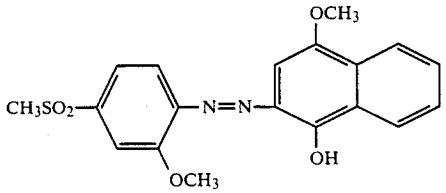
Dye (5)
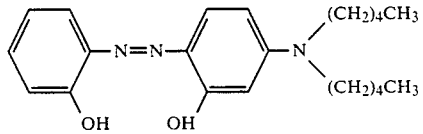
Dye (6)
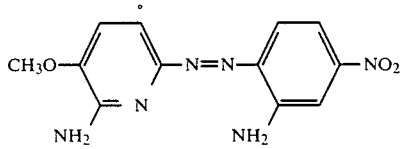
Dye (7)
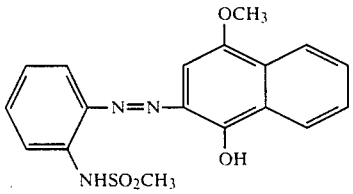
Dye (8)
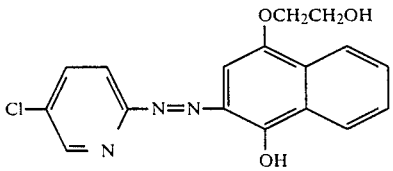
Dye (9)
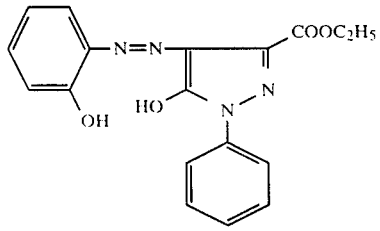

-continued
Dye (10)
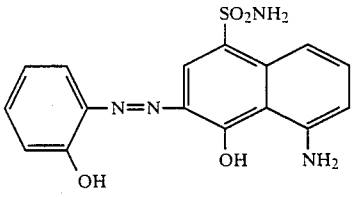
Dye (11)
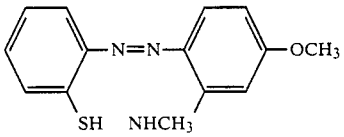
Dye (12)
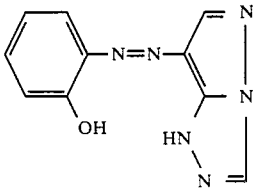
Dye (13)
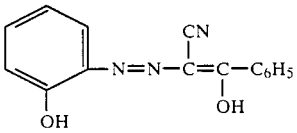
Dye (14)
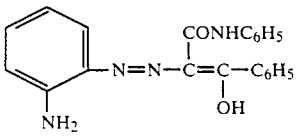
Dye (15)
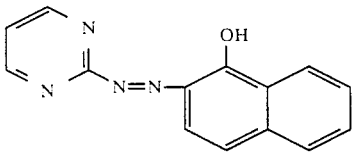
Dye (16)
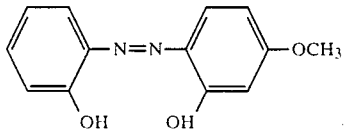
Dye (17)
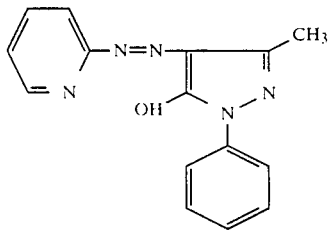

-continued
Dye (18)
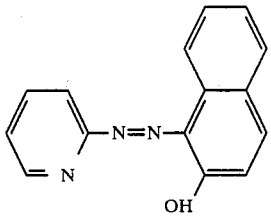
Dye (19)
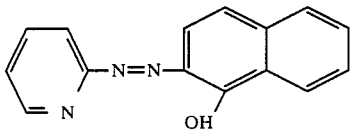
Dye (20)
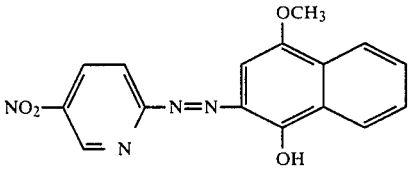
Dye (21)
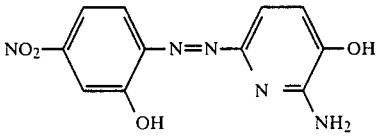
Dye (22)
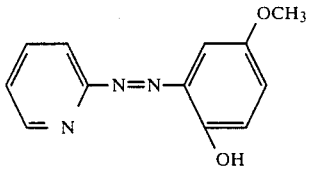
Dye (23)
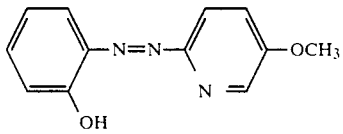
Dye (24)
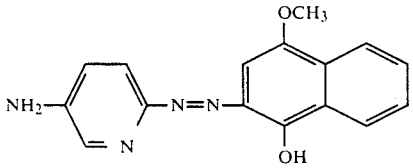
Dye (25)
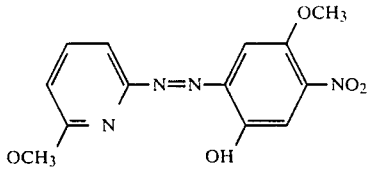
Dye (26)
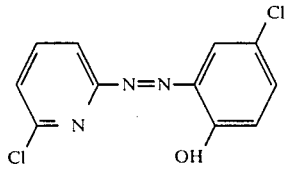
(Illustrative color-providing materials)

-continued
CPM (1)
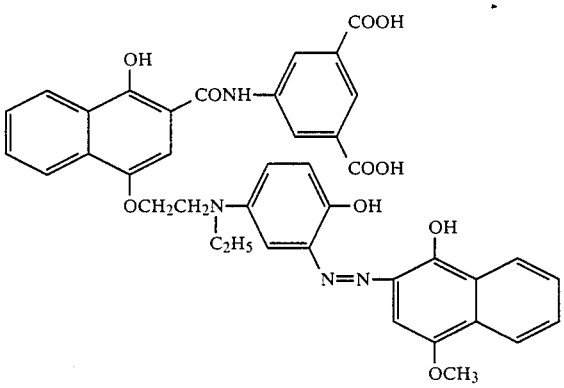
CPM (2)
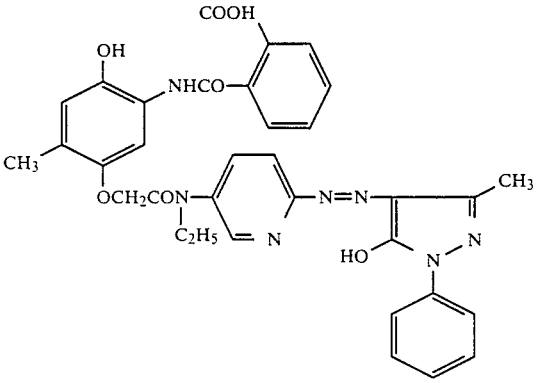
CPM (3)
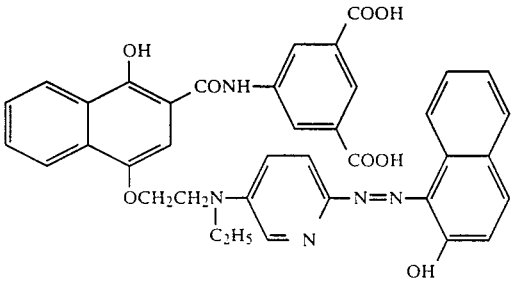
CPM (4)
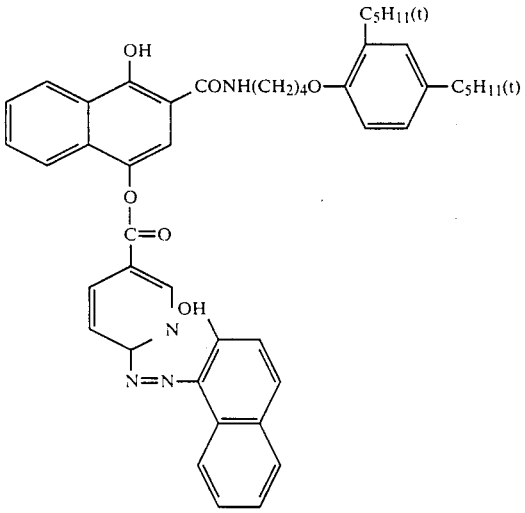

-continued
CPM (5)
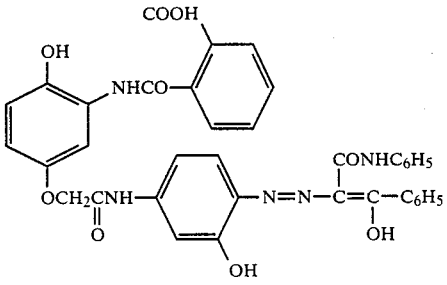
CPM (6)
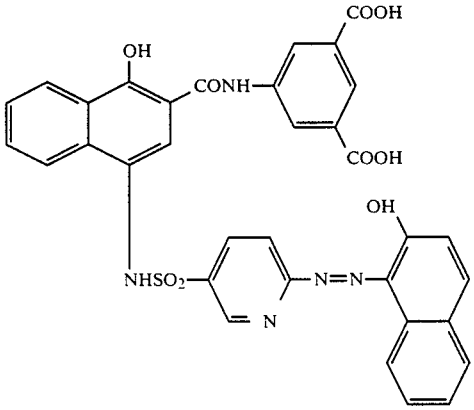
CPM (7)
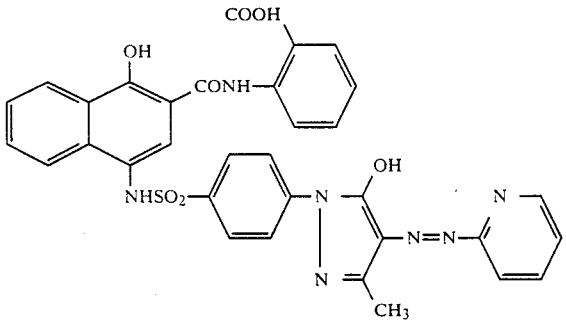
CPM (8)
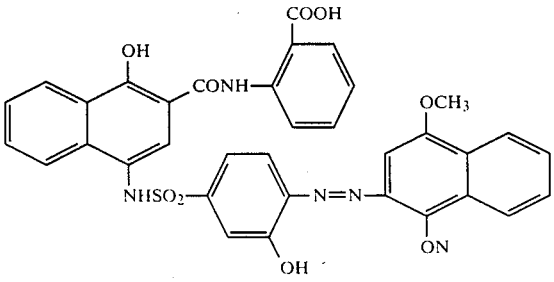

-continued
CPM (9)
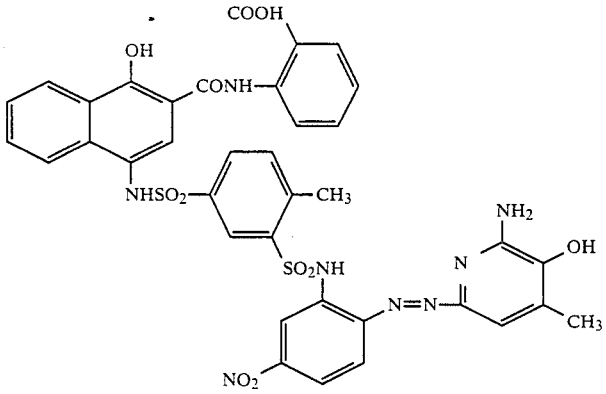
CPM (10)
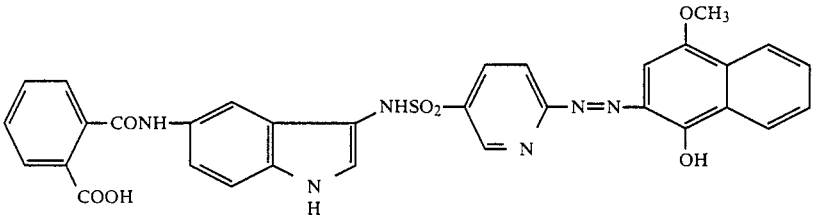
CPM (11)
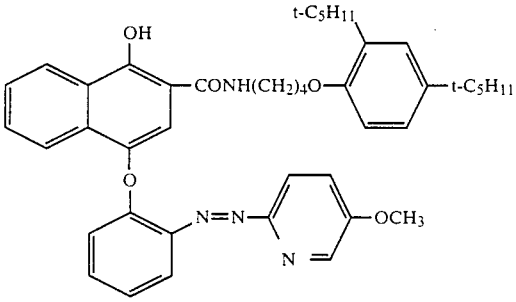
CPM (12)
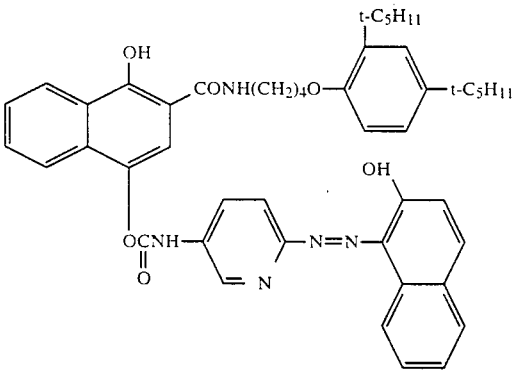
CPM (13)
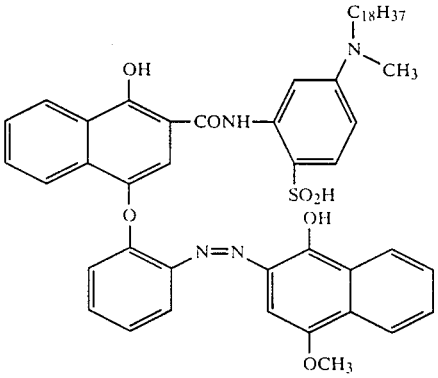

-continued

CPM (14)

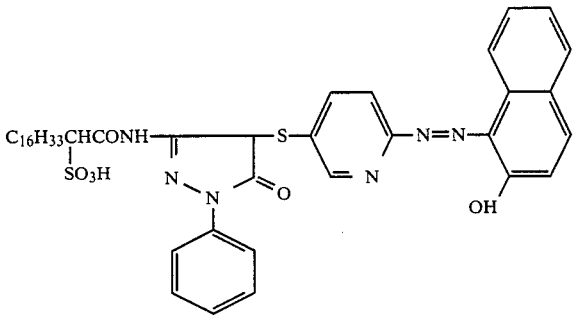

CPM (15)

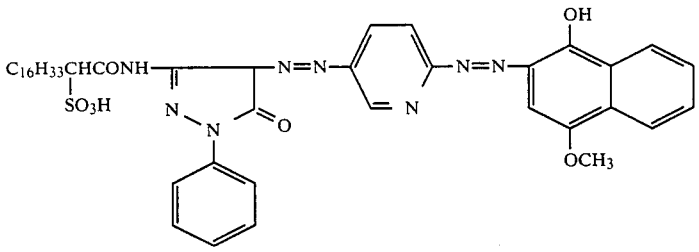

CPM (16)

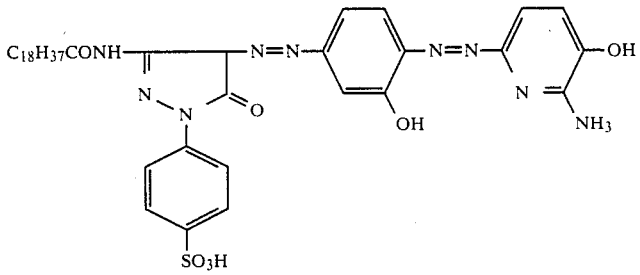

The method of forming a color image according to the present invention is hereunder described by working examples which are given here for illustrative purposes only and are by no means intended to limit the scope of the invention.

EXAMPLE 1

Silver behenate (4.5 g) was mixed with toluene (20 cc), acetone (20 cc) and polyvinyl butyral (3.2 g), and the mixture was treated by an ultrasonic homogenizer to prepare Dispersion (1).

Behenic acid (3.4 g) was dissolved in 8 wt% solution of polyvinyl butyral in acetone (40 cc) under heating, and the solution was stirred under cooling with ice to prepare Dispersion (2).

Phthalic acid (0.20 g), phthalazine (0.13 g), a developing agent (2.55 g) of the formula indicated below and 0.82 g of CPM (3) were dissolved in 8 wt% solution of polyvinyl butyral in acetone (40 cc) to prepare Solution (1):

Developing agent

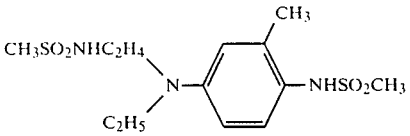

Silver trifluoroacetate was reacted with lithium bromide in 10 wt% solution of polyvinyl butyral in acetone to prepare Emulsion (1).

A mixture of 10 cc of Dispersion (1) and an equal volume of Dispersion (2) was further mixed with a 0.05 wt% methanol solution of a sensitizing dye of the formula indicated below and 20 mg of mercuric acetate:

Sensitizing dye

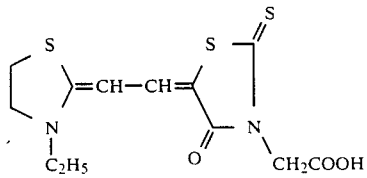

To the mixture, Solution (1) was added, and the resulting coating solution was applied onto a transparent polyester film with a wire bar to form a photosensitive layer having a wet thickness of 74 μm. The resulting photosensitive sample was given an exposure of 30,000 CMS through a step wedge.

An image-receiving sheet was prepared by forming on a transparent polyethylene terephthalate film a dye mordant layer made of $Ni^{2+}$ metallized poly(1-vinylimidazole)-co-(1-vinyl-3-benzylimidazolium chloride)-co-(1-vinyl-3-(3-aceto-4-hydroxybenzyl)-imidazolium chloride). This image-receiving sheet was wetted with tributyl phosphate, superimposed on the exposed photosensitive sample, and pressed under an electric iron (surface temperature: 150° C.) for 30 seconds. Then, the image-receiving sheet was separated from the photosensitive sample and a negative magenta image having a max. reflection density of 1.07 and min. reflection density of 0.31 was formed on the image-receiving sheet.

EXAMPLE 2

A photosensitive sample was prepared as in Example 1 except that CPM (3) was replaced by 0.81 g of CPM (7). The sample was exposed as in Example 1 and assembled with an image-receiving sheet prepared as in Example 1. Upon heat development, a negative yellow image having a max. reflection density of 0.66 and a min. reflection density of 0.29 was formed on the image-receiving sheet.

EXAMPLE 3

On the photosensitive layer of the sample of Example 1, a layer of hot-melted acetamide was formed in a dry thickness of 25 μm. The resulting sample was given an exposure of 30,000 CMS through a step wedge, assembled with an image-receiving sheet as prepared in Example 1, and pressed with an electric iron (surface temperature: 150° C.) for 30 seconds. Then, the image-receiving sheet was separated from the photosensitive sample, and a negative magenta image having a max. reflection density of 1.11 and a min. reflection density of 0.39 was formed on the image-receiving sheet.

EXAMPLE 4

The below indicated components were mixed in an alumina ball mill to prepare Dispersion (3):

| | |
|---|---|
| 4-Hydroxybenzotriazole (silver salt) | 8.71 g |
| CPM (1) | 11.8 g |
| Ossein gelatin (10 wt % aqueous solution) | 84.0 cc |
| Water | 120.0 cc |
| Methanol | 96.0 cc |

The below indicated components were mixed in an alumina ball mill to prepare Solution (2):

| | |
|---|---|
| Ossein gelatin (10 wt % aqueous solution) | 42.0 cc |
| Developing agent 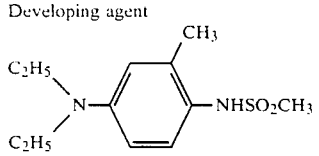 | 1.38 g |
| 4-Aryl-3-amino-5-mercapto-1,2,4-triazole | 28.0 mg |
| Methanol | 10.5 cc |
| Emulgen 950 (product by Kao-Atlas Co. Ltd.) | 245.0 mg |
| Dimethylurea | 7.0 g |

A mixture of 25 cc of Dispersion (3) and 15 cc of Solution (2) was prepared, and a silver bromide-gelatin emulsion (av. grain size:0.04 μm, 0.11 g as silver) was added to the mixture. The resulting coating solution was applied to a sheet of photographic baryta paper to form a photosensitive layer.

An aqueous solution containing 15% water-soluble polyvinyl butyral and 10% nickel chloride was applied to a sheet of ivory paper to form a image-receiving sheet in such an amount that 1.40 g of polyvinyl butyral was present per square meter.

After giving the photosensitive sample an exposure of 30,000 CMS through a step wedge, the image-receiving sheet containing a nickel chloride layer was wetted and superimposed on the photosensitive sample. The web was pressed with an electric iron (surface temperature: 150° C.) for 30 seconds. Then, the image-receiving sheet was separated from the photosensitive sample, and a negative magenta image having a max. reflection density of 0.83 and a min. reflection density of 0.26 was formed on the image-receiving sheet.

EXAMPLE 5

A photosensitive sample was prepared as in Example 1 except that CPM (3) was replaced by 0.91 g of CPM (12). The sample was exposed as in Example 1. An aqueous solution containing 15% water-soluble polyvinyl butyral and 10% nickel chloride was applied to a sheet of ivory paper to form a image-receiving sheet in such an amount that 1.40 g of polyvinyl butyral was present per square meter. The so prepared image-receiving sheet was super-imposed on the exposed photosensitive sample and pressed with an electric iron (surface temperature: 170° C.) for 30 seconds. Then, the image-receiving sheet was separated from the photosensitive sample, and a negative magenta image having a max. reflection density of 0.83 and a min. reflection density of 0.27 was formed on the image-receiving sheet.

EXAMPLE 6

A photosensitive sample was prepared as in Example 1 except that CPM (3) was replaced by 0.91 g of CPM (12) and 0.32 g of dimethylurea was added to Dispersion (1). This sample was exposed as in Example 1, and combined with an image-receiving sheet the same as prepared in Example 5. The web was pressed with an electric iron (surface temperature: 150° C.) for 30 seconds. Then, the image-receiving layer was separated from the photosensitive sample, and a negative magenta image having a max. reflection density of 1.51 and a min. reflection density of 0.24 was formed on the image-receiving sheet.

EXAMPLE 7

A photosensitive sample was prepared as in Example 1 except that CPM (3) was replaced by 0.91 g of CPM (12). This sample was exposed as in Example 1, assembled with an image-receiving sheet the same as prepared in Example 1, and given a heat treatment as in Example 1. A negative magenta image having a max. reflection density of 1.15 and a min. reflection density of 0.27 was formed on the image-receiving sheet.

EXAMPLE 8

Testing fixability and light-fastness

Solutions of 50 mg of Dye (16), Dye (18) and Dye (20) in 10 cc of methanol containing 8% polyvinyl butyral were coated onto polyester films with a wire bar to form dye layers having a wet thickness of 55 μm, and each web was dried.

Two types of image-receiving sheet were prepared: those of the first type were prepared as in Example 5 and had a nickel chloride containing polyvinyl butyral layer, and those of the second type had a polyvinyl butyral layer containing no nickel chloride. These image-receiving sheets were superimposed on the dye layers and pressed with an electric iron (surface temperature: 150° C.) for one minute to transfer the respective dyes onto the image-receiving sheets.

The dyes on the image-receiving sheets were again transferred onto other receiving sheets by pressing with an electric iron (surface temperature: 110° C.) for 10 minutes. The optical density (λmax) of the dye was measured for both before (Do) and after (D) the retransferance, and the values of the percent residual dye expressed by D/Do×100 are shown in Table 1. The greater the percent residual dye, the greater the fixability of the dye.

Dye (16), Dye (18) and Dye (20) were transferred onto image-receiving sheets in the same manner as above, and they were exposed to a xenon lamp (6,000 W) for 48 hours (the light intensity on the sheets was 60,000 lux). The optical density (λmax) of the dye was measured for both before (Do) and after (D) the exposure, and the values of the percent residual dye expressed by D/Do×100 are also shown in Table 1.

TABLE 1

| Parameter | Sample | Dye No. 16 | 18 | 20 |
|---|---|---|---|---|
| λmax | Ni-containing image-receiving sheet | 464 nm | 530 nm 570 nm | 645 nm |
| | Ni-free image-receiving sheet | 452 nm | 470 nm | 610 nm |
| fixability | Ni-containing image-receiving sheet | 92% | 100% | 98% |
| | Ni-free image-receiving sheet | 47% | 62% | 82% |
| light-fastness | Ni-containing image-receiving sheet | 93% | 100% | 97% |
| | Ni-free image-receiving sheet | 47% | 20.3% | 41% |

What is claimed is:

1. A method of forming a color diffusion transfer image by heat development comprising (1) imagewise exposing a thermally developable photosensitive material containing a photosensitive silver halide, an organo silver salt, and a thermally non-diffusing color providing material capable of releasing a chelatable and sublimable dye upon heat development, (2) thermally developing the exposed photosensitive material to form an imagewise pattern of said dye, and (3) diffusing and heat transferrring at least part of said imagewise pattern into an image-receiver containing a polyvalent metallic ion, superimposed on said photosensitive material, thereby forming an imagewise pattern of said dye which has chelated with the polyvalent metallic ion on said image-receiver.

2. A method according to claim 1, wherein said thermally non-diffusing color providing material is a material represented by the following formula (I)

Formula I

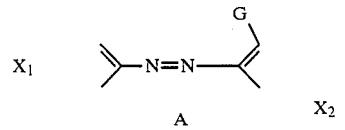

wherein $X_1$ represents a group of atoms necessary to form aromatic or heterocyclic rings at least one of which has 5 to 7 atoms and in which at least one of the atoms adjacent the carbon atom bonded to the azo bond is (a) a nitrogen atom or (b) a carbon atom bonded to a nitrogen, oxygen or sulfur atom; $X_2$ represents a group of atoms necessary to form aromatic or heterocyclic rings at least one of which has 5 to 7 atoms; G represents a chelating group; and A represents a group capable of releasing a diffusible dye as a function of heat development.

3. A method according to claim 2, wherein $X_1$ is selected from a group of atoms necessary to form aromatic or heterocyclic rings at least one of which has 5 to 7 atoms and in which at least one of the atoms adjacent the carbon atom bonded to the azo bond is a nitrogen atom.

4. A method according to claim 3, wherein said $X_1$ is a pyridyl ring.

5. A method according to claim 2, wherein $X_2$ is selected from a benzene, naphthalene, pyridine, quinoline and pyrazolone ring.

6. A method according to claim 2, wherein G is selected from a hydroxyl, amino, methoxy, thiol and thioalkoxy group.

7. A method according to claim 2, wherein $X_1$ and $X_2$ are individually selected from aromatic rings, substituted by an alkyl, alkoxy, cyano, hydroxyl, amino or halogen.

8. The method of claim 1, wherein said thermally non-diffusing color providing material is of Formula

II

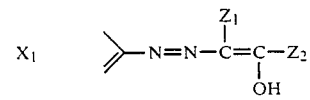

wherein $X_1$ represents a group of atoms necessary to form aromatic or heterocyclic rings, at least one of which has 5 to 7 atoms and in which at least one of the atoms adjacent to the carbon atom bonded to the azo bond is (a) nitrogen or (b) carbon which carbon has a nitrogen, oxygen, or sulfur atom attached thereto; A is a group capable of releasing a chelatable and sublimable dye on heat development, $Z_1$ is an electron attracting group, and $Z_2$ is selected from alkyl and aryl.

9. A method according to claim 8, wherein $Z_2$ is an alkyl group.

* * * * *